United States Patent [19]

Weisz

[11] 4,421,041

[45] Dec. 20, 1983

[54] NEEDLE DESIGN AND CLAMPING SYSTEM

[75] Inventor: William Weisz, Tenafly, N.J.

[73] Assignee: The Singer Company, Stamford, Conn.

[21] Appl. No.: 309,296

[22] Filed: Oct. 7, 1981

[51] Int. Cl.[3] ..... D05B 55/02; D05B 85/02

[52] U.S. Cl. ..... 112/226

[58] Field of Search ..... 112/222, 226; 66/114

[56] References Cited

U.S. PATENT DOCUMENTS

| | | | |
|---|---|---|---|
| 127,765 | 6/1872 | Heidenthal | 112/226 X |
| 141,245 | 7/1873 | Wardwell, Jr. | 112/226 X |
| 834,436 | 10/1906 | Wilson | 112/226 X |
| 1,893,528 | 1/1933 | Winkler | 66/114 X |
| 2,402,251 | 6/1946 | Johnson | 112/226 X |
| 3,344,761 | 10/1967 | Ross | 112/226 |
| 3,583,345 | 6/1971 | Wilson et al. | 112/226 |
| 3,587,498 | 6/1971 | Weisz | 112/226 |
| 3,658,022 | 4/1972 | Ross | 112/226 |
| 3,753,412 | 8/1973 | Sheppard et al. | 112/222 |

FOREIGN PATENT DOCUMENTS

| | | | |
|---|---|---|---|
| 2567 | of 1872 | United Kingdom | 112/226 |

*Primary Examiner*—Wm. Carter Reynolds

*Attorney, Agent, or Firm*—Edward P. Schmidt; Robert E. Smith; Edward L. Bell

[57] ABSTRACT

A needle design and retention system in which the sewing needle is formed with a locator portion at the end of the shank that is substantially normal thereto. The locator portion may be parallel to the axis of the thread carrying eyelet and the sewing needle or may form a known angle with the plane including the needle axis and the axis of the thread carrying eyelet. The locator portion of the sewing needle extends through a transverse aperture in an enlarged end in a slabbed rod affixed to the sewing machine needle bar. The enlarged end is also grooved to accommodate a portion of the shank. A clamping sleeve is provided having an axially aligned aperture which surrounds the enlarged end of the slabbed rod and the sewing needle shank to retain the sewing needle affixed thereto. The clamping sleeve is provided with a counterbore which receives a coil spring which encircles the rod and is captured between the bottom of the needle bar and the ends of the counterbore. The clamping sleeve may be elevated against the pressure of the coil spring to enable insertion or removal of the sewing needle with the locator portion in the transverse aperture in the end of the rod and the shank in the groove therein. The clamping sleeve is automatically returned to a retaining position by the coil spring.

2 Claims, 5 Drawing Figures

NEEDLE DESIGN AND CLAMPING SYSTEM

DESCRIPTION

BACKGROUND OF THE INVENTION

The present invention relates to a needle for a sewing machine; more particularly, to a needle allowing visual observation of insertion in a clamping device, not susceptible of faulty installation in a clamping device, and of a clamping device therefor.

Conventional needles for use in household sewing machines are produced with a reference flat in a butt end for orientation during insertion and fastening to the needle bar of the sewing machine. The needle is inserted blindly, coaxially with the axis of the needle bar into a clamping device comprising a multiplicity of components such as a clamp body, an orienting gib, and a fastening screw. Economy clamping sets do not contain a gib to aid in sewing needle orientation. Thus, in economy clamping sets it is normally possible to insert a needle in the wrong orientation, causing sewing difficulties due to improper location of the thread grooves in the needle and/or of the needle eye with respect to the loop taker. In clamping devices with a gib, proper orientation is assured by the flat, but initially inserting the needle can be frustrating because there is a 50% chance of presenting the needle shank out of the required alignment on the first trial. Needle insertion, in any event, is accomplished blindly because of the need to load the needle axially with the needle driving bar. The necessity for a clamping torque on the fastening screw provides another source of problems in that needles too loosely clamped may damage the sewing machine or harm the operator, whereas needles too tightly clamped to avoid the bad effects of loose clamping may present difficulties during removal.

What is required is a sewing needle design and clamping system therefore, which permits a sewing machine operator to visually obtain correct loading of the sewing needle, and proper clamping thereof, without the difficulties encountered, and the multiplicity of fine parts required, with the prior art constructions.

SUMMARY OF THE INVENTION

The above requirements have been obtained in the invention in which a needle for a sewing machine is fashioned in the usual way with a thread carrying eyelet on the pointed end; with, however, the end of the shank portion thereof formed at right angles to the initial shank portion in order to obtain a locator for the thread carrying eyelet with respect to the needle bar for readily achieving proper orientation of the sewing needle, as well as providing means for preventing axial displacement of the needle in relation to said needle bar when inserted in a locating bore. A needle clamp is provided having a slabbed rod which is affixed to the internal diameter of a needle bar. The slabbed rod is formed with an enlarged end, similiarly slabbed and grooved and transversely bored to receive the shank and locator, respectively, of the sewing needle. A clamping sleeve is provided having a hollow interior to accomodate a compression spring which surrounds the slabbed rod and extends between the end of a needle bar and an internal land on the clamping sleeve. The clamping sleeve is formed on its lower end with an internal aperture shaped to fit about the enlarged end of the slabbed rod. The clamping sleeve is prevented from being urged off the slabbed rod by an internal land impinging on the enlarged end of the slabbed rod. One surface of the internal aperture of the clamping sleeve engages the shank of the sewing needle and securely clamps the same to the slabbed rod which is affixed to the needle bar. It is readily apparent that the compression spring constantly urges the clamping sleeve in a clamping direction, thus providing fail-safe holding of the needle. The clamping sleeve must be urged in the opposite direction to load or to remove the needle.

DESCRIPTION OF THE DRAWINGS

Having in mind the above and other objects that will be evident from an understanding of this disclosure, the invention comprises the devices, combinations and arrangements of parts as illustrated in a presently preferred embodiment of the invention which is hereinafter set forth in such detail as to enable those skilled in the art readily to understand the function, operation, construction and advantages of it when read in conjunction with the accompanying drawings in which:

Referring now to FIG. 1, there is shown the head end 10 of a sewing machine below which extends a presser bar 12, which presser bar terminates in a presser foot 14 urged by means well known in the sewing machine art, against a feed dog 16 part of a feeding system which may be one of many varieties well known in the sewing machine art, which feed dog extends through throat plate 18 carried in the bed 20 of the sewing machine. Situated forwardly of the presser bar 12 is a hollow needle bar 22 which needle bar terminates in a needle clamp 24 for retaining a sewing needle 26 affixed to the end of the needle bar.

Referring now to FIG. 2, there is shown an exploded view for indicating the construction of the needle clamp 24 by which the sewing needle 26 is retained, and the attachment thereof to the hollow needle bar 22. The needle clamp 24 includes a needle clamping sleeve 28 having a counterbore 30 for receiving a coil spring 34, and atop the coil spring the needle bar 22. The end of the needle clamping sleeve 28 is fashioned with an axially aligned D-shaped aperture 32 (see also FIG. 4). An internal land 31 at the base of the 30 provides a seat for the coil spring 34 as well as providing an abutment 33 separating the internal bore from the D-shaped hole aperture 32 (see also FIGS. 3A and 3B). An orifice 35 extends between counterbore 38 and D-shaped aperture 34, to provide communication therebetween. The needle clamping sleeve 28 is also formed with an attachment driving stud 29, used for driving a buttonholer attachment, or a special purpose darning foot, for example.

Figure 1:
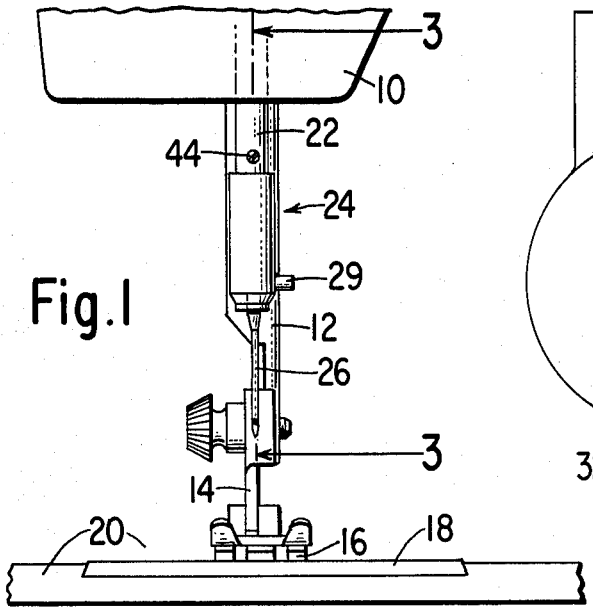
FIG. 1 is an elevational view of a portion of a typical sewing machine head end including a needle bar equipped with the sewing needle and needle clamp of the present invention.

A slabbed rod 36 is provided having an outside diameter which fits into the hollow interior of the needle bar 22. The slabbed rod 36 extends through the orifice 35 and into the hollow interior of the needle bar 22. A lower portion of the slabbed rod 36 is formed with an enlarged end 38 which fits into the D-shaped aperture 32 of the clamping sleeve 28 and abuts the abutment 33 thereof. The enlarged D-shaped end 38 of the slabbed rod 36 is grooved 39 and bored 40 transversely therethrough for a purpose which will be explained below. The slabbed rod 36 is fashioned on its upper end which extends into the needle bar 22 with a counterbore 42 upon which a set screw 44 carried by the needle bar 22 may impinge to retain the slabbed rod in a specific position.

Thus far has been described a needle clamp 24 which may be attached to the end of a needle bar 22. The purpose for arranging this specific type of needle clamp 24 upon the end of a needle bar 22 is to enable the use of a particular sewing needle 26 which will now be described. The sewing needle 26 includes the usual point 46 on a first axis 47 having a thread carrying eyelet 48 on a second axis 49 immediately adjacent thereto in a blade 50 thereof, which blade extending along a first axis 47 enlarges into a shank 52. However, instead of terminating in a shank as in the prior art sewing needles, the skank 52 terminates in a locator portion 54 extending along a third axis 55 substantially at right angles (normal) to the shank, preferably in a direction substantially parallel to the second axis of the thread carrying eyelet 48, although any known angle to a plane including the first and second axis may be accommodated to suit a particular mounting and loop taker arrangement. The groove 39 in the enlarged end 38 of the slabbed rod 36 is fashioned to receive the shank 52 of the needle 26, and the transverse bore 40 therein is to receive the locator portion 54 at the end of the shank. The thread carrying eyelet 48 of the sewing needle 26 is precisely located to cooperate with the sewing machine looptaker (not shown) by the locator portion 54 thereof which is inserted in the transverse bore 40 of the slabbed rod 36, which slabbed rod is connected in a specific position with respect to the needle bar 22 by the set screw 44 and counter bore 42. Precisely how the sewing needle 26 may be installed in the needle clamp 24 may now be explained below.

Figure 4:
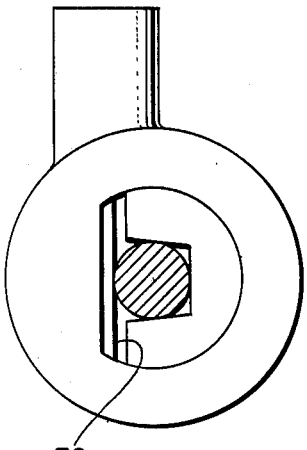
Figure 2:
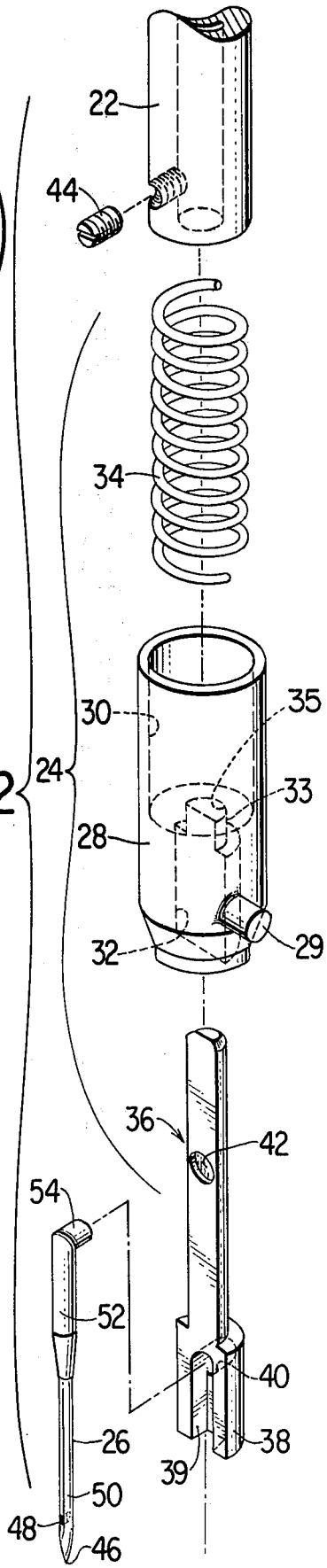
FIG. 2 is an exploded perspective view of the needle clamp and sewing needle shown in FIG. 1.
Figure 3A:
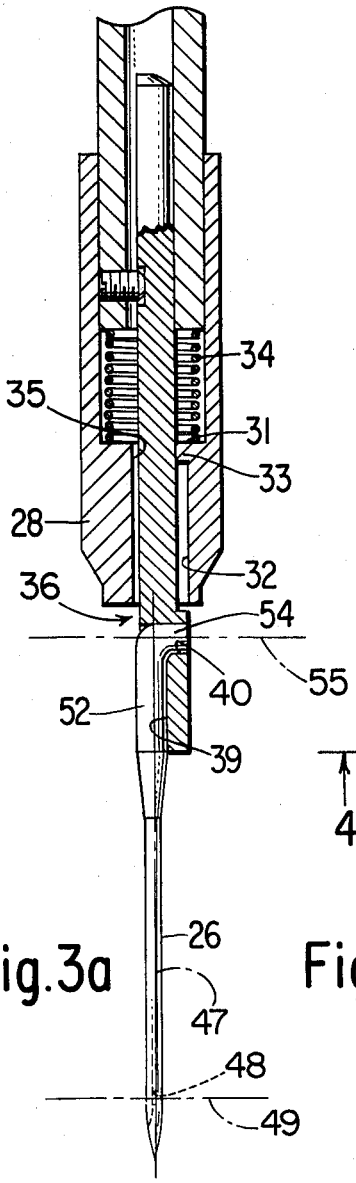
FIGS. 3A and 3B are cross sectional views taken along line 3—3 of FIG. 1 of the needle bar, needle clamp and needle in, respectively, the needle insertion position and the needle clamped position; and, FIG. 4 is a cross section taken along line 4—4 of FIG. 3B to indicate the manner in which the sewing needle is retained by the needle clamp.
Figure 3B:
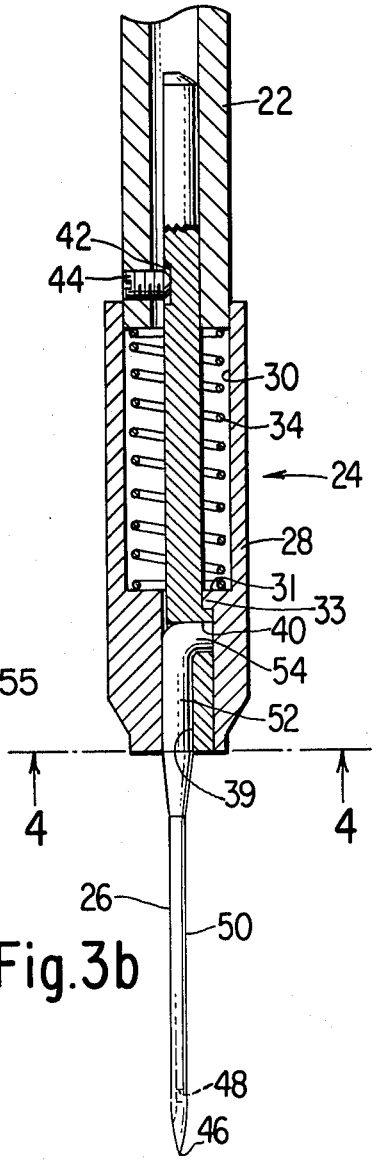

Referring now to FIG. 3A, it will be observed that the needle clamping sleeve 28 has been moved upwardly with respect to the needle bar 22 against the urgings of the coil spring 34 to expose the end of the slabbed rod 36 which has been grooved 39 and bored 40. The sewing needle 26 may have the locator portion 54 thereof inserted into the transverse bore 40 in the slabbed rod 36 and the shank 52 of the sewing needle may be inserted in the groove 39. By releasing the clamping sleeve 28, the sleeve is forced downwardly over the shank 52 of the sewing needle 26, as is shown in FIG. 3B by the urging of coil spring 34. The groove 39 in the enlarged end 38 of the slabbed rod 36 may be formed with tapered sides to clasp the sides of the shank 52 of the sewing needle 26 and the D-shaped aperture 32 in the clamping sleeve 28 may also be somewhat tapered inwardly towards the orifice 35 to provide for an increase of clamping force on the sewing needle as the clamping sleeve comes to the position shown in FIG. 3B (see FIG. 4) to insure that the locator portion 54 and shank 52 are firmly retained.

Thus has been disclosed a sewing needle which may be easily inserted and may only be inserted in one correct position. The locator portion 54 of the sewing needle 26 positioned in the transverse bore 40 of the slabbed rob 36 insures that the sewing needle will be precisely located with respect to the needle bar 22. The locator portion 54 of the sewing needle 26 also insures that the sewing needle will have the thread carrying eyelet 48 thereof correctly aligned for cooperation with sewing instrumentalities in the bed 20 of the sewing machine and generally prevent needle movement in any direction along the axis of the needle bar. By avoiding the heretofore used axial loading of a sewing needle, and, instead, loading perpendicular to the needle bar axis, loading of the sewing needle 26 into the needle clamp 24 may be completely accomplished within the view of the sewing operator who is installing the needle. The coil spring 34 urging the clamping sleeve 28 to a position to retain the sewing needle 26 may be changed to a heavier or lighter spring to control the clamping force on the needle securing the same to the needle bar 22. Sewing needle 26 is positively retained, and may only be removed by displacing the needle clamping sleeve 28 against the urgings of the coil spring 34, thereby obviating the danger of under or over torquing of the heretofore used needle clamp.

It will be apparent to those skilled in the art that, the locator portion 54 need not have the same cross section as the shank 52, does not have to be parallel to the axis of the needle eye, and may be at an angle other than normal to the shank. Other changes may also be made in the form of the needle 26 and needle clamp 24 without departing from the invention claimed.

I claim:

1. For a sewing machine or like mechanism utilizing a needle bar to carry a sewing needle having a point and a thread carrying eyelet adjacent to the point, through a work material, a needle clamping system comprising:

a sewing needle having an elongated blade having a first axis and a point at one end, and eye extending along a second axis through said blade adjacent said point, said blade opening up opposite said point to an enlarged shank, said shank terminating in a locator portion extending along a third axis substantially normal to said shank and forming a known angle with a plane including said first axis and said second axis; and means for clamping said sewing needle to said needle bar with said eye maintained in a specific position with respect to said needle bar, said clamping means further comprising a rod having an enlarged end with a transverse bore adjacent said end for receiving said locator portion of said needle and a groove extending from said transverse bore to said end for receiving said shank of said needle; a clamping sleeve having an axially aligned aperture extending from one end to receive said enlarged end of said rod with said locator portion and shank of said needle therein to be firmly retained thereby, an orifice communicating with said axially aligned aperture for accommodating passage of said rod, and a counterbore extending from said orifice to the other end of said clamping sleeve; a compression spring accommodated about said rod in said counterbore; and means for affixing said rod to said needle bar with said eye of said needle in said specific position, whereby said clamping sleeve may be axially shifted in opposition to said compression spring to expose said enlarged end of said rod so as to remove or install a needle with said locator portion in said transverse bore and said shank in said groove of said rod, and whereby said clamping sleeve may be urged by said compression spring to have said axially aligned aperture thereof firmly retain said needle to said rod.

2. A needle clamping system as claimed in claim 1 wherein that portion of said axially aligned aperture in engagement with said locator portion and shank of said needle is tapered inwardly towards said orifice to insure that said locator portion and said shank of said needle are firmly retained.

* * * * *